US005136796A

United States Patent [19]

Farrington

[11] Patent Number: 5,136,796

[45] Date of Patent: Aug. 11, 1992

[54] STEAM IRON SPRAY OR SURGE PUMP SELECTOR VALVE HAVING AN ANGLED VALVE SURFACE

[75] Inventor: Richard I. Farrington, Seymour, Conn.

[73] Assignee: Black & Decker Inc., Newark, Del.

[21] Appl. No.: 646,111

[22] Filed: Jan. 28, 1991

[51] Int. Cl.[5] ..... D06F 75/18; D06F 75/22

[52] U.S. Cl. ..... 38/77.5; 38/77.83

[58] Field of Search ..... 38/77.1, 77.5, 77.7, 38/77.8, 77.82, 77.83, 88

[56] References Cited

U.S. PATENT DOCUMENTS

| | | | |
|---|---|---|---|
| 3,001,305 | 9/1961 | Sardeson | 38/77.5 |
| 3,128,568 | 4/1964 | Schwartz, Jr. | 38/77.5 |
| 3,691,660 | 9/1972 | Gronwick et al. | 38/77.83 |
| 3,820,259 | 6/1974 | Flowers | 38/77.5 |
| 3,881,265 | 5/1975 | Eaton et al. | 38/77.5 |
| 4,170,835 | 10/1979 | Bain, Jr. | 38/77.5 |
| 4,398,364 | 8/1983 | Augustine et al. | 38/77.5 |
| 5,038,501 | 8/1991 | Hipp et al. | 38/77.5 |

FOREIGN PATENT DOCUMENTS

| | | | |
|---|---|---|---|
| 0080634 | 6/1983 | European Pat. Off. | 38/77.5 |
| 3510993 | 10/1986 | Fed. Rep. of Germany | 38/77.83 |
| 0258253 | 7/1988 | Fed. Rep. of Germany | 38/77.5 |
| 1143095 | 6/1986 | Japan | 38/77.83 |

*Primary Examiner*—Werner H. Schroeder
*Assistant Examiner*—Ismael Izaguirre
*Attorney, Agent, or Firm*—Barry E. Deutsch

[57] ABSTRACT

A combination pump and spray or surge function selector valve for an electric iron comprises a valve stem having a user operated member on a first end and a valve member with an angled sealing surface on a second end. A housing is spaced circumferentially about the valve member and includes a first water inlet and a pair of water outlets in fluid flow communication with said inlet. The stem is movable in a first direction relative to the housing so that the angled sealing surface selectively connects the water inlet with a selected one of the outlets while discontinuing communication between the inlet and the other of said outlets. The stem is movable in a second direction relative to the housing to pump water from the inlet to the selected one water outlet.

6 Claims, 2 Drawing Sheets

STEAM IRON SPRAY OR SURGE PUMP SELECTOR VALVE HAVING AN ANGLED VALVE SURFACE

BACKGROUND OF THE INVENTION

1. FIELD OF THE INVENTION

This invention relates to electric irons and in particular to a combination pump and spray or surge function selector valve therefor.

2. DESCRIPTION OF THE RELATED ART

In the field of electric irons of the type that are commonly used in the modern household, many of the irons include means to emit a spray of water droplets onto the object to be ironed which is positioned in the path of movement of the iron. This spray function is used when ironing certain fabrics and the spray function is controlled by the user of the iron.

The typical modern steam iron also generally includes a "surge" function. The surge function increases the speed and effectiveness of the steam iron in removing wrinkles from certain fabrics by enabling the user of the iron to selectively generate relatively large quantities of steam at intermittent times in the ironing process.

Typically, the spray and surge functions utilize separate pumps and controls, or a single pump with a separate control to select the desired function, thereby, increasing the cost and complexity of the iron's manufacture. Further, reliability of the iron may be decreased due to the number of separate components used to develop the surge and spray functions.

Accordingly, it is an object of this invention to manufacture an electric iron having surge and spray functions which utilizes a single control to operate the pump and to select the spray or surge function.

SUMMARY OF THE INVENTION

The foregoing object and other objects of the invention are attained in an electric iron having a soleplate, a housing connected to the soleplate, and a water tank associated with the housing and having a water inlet and at least one water outlet. The iron further includes a combination pump and spray or surge function selector valve which includes an axially extending stem extending through said housing and having a first user operated member mounted at a first end and a valve member mounted at a second end. Housing means are spaced circumferentially about the valve member and has a first water inlet in communication with the water outlet from the water tank and a pair of water outlets in fluid flow communication with the inlet. The stem is rotatable so that the valve member selectively connects the water inlet with a selected one of the outlets while discontinuing communication between the inlet and the other of said outlets. The stem is axially movable relative to the housing means to pump water from the water inlet to the selected one water outlet. The first water outlet provides water for the spray function and the second water outlet provides water for the surge function.

DESCRIPTION OF THE PREFERRED EMBODIMENT

Figure 1:
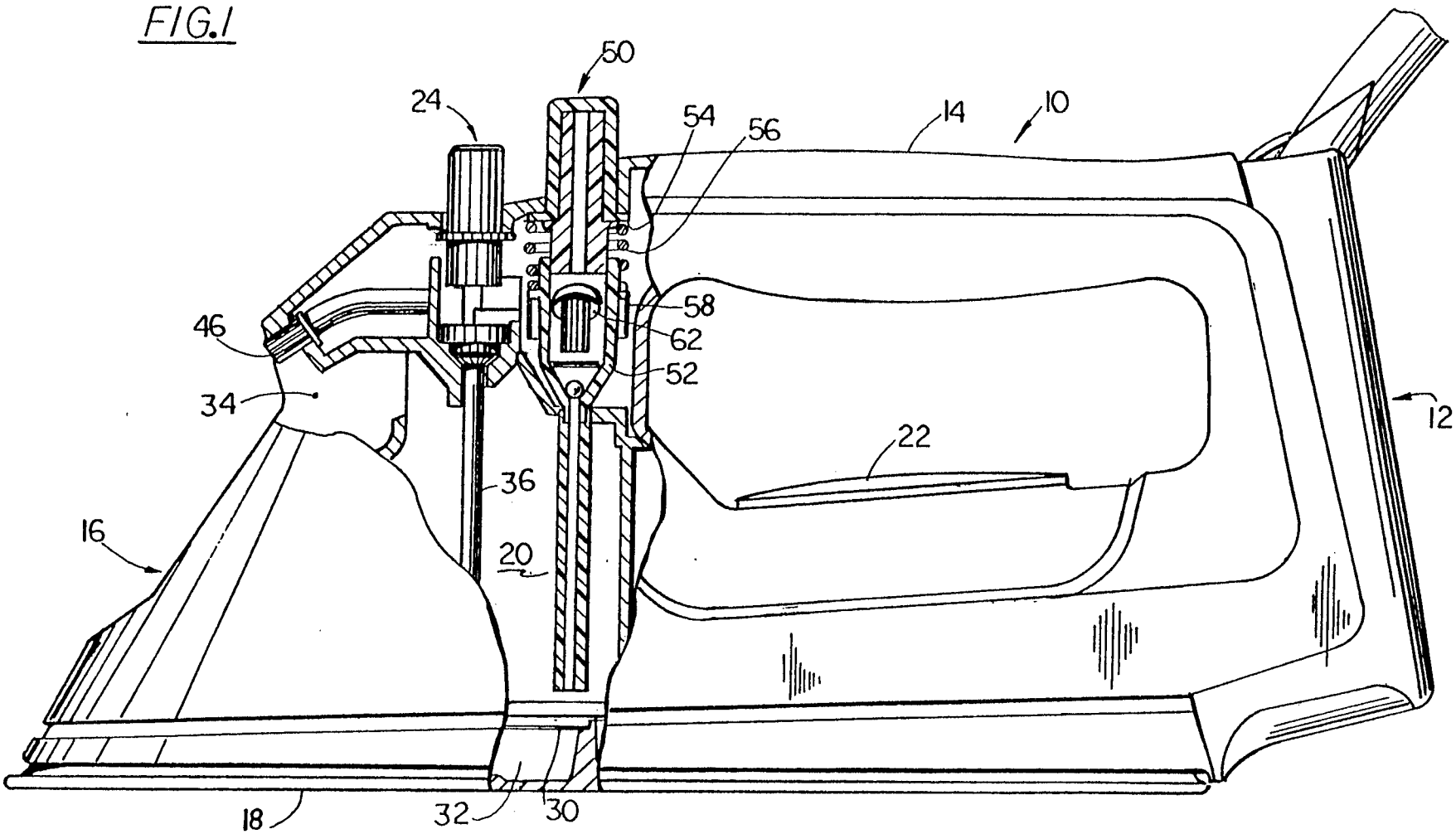
FIG. 1 is a side view, partially in cross section, of an electric steam iron incorporating a pump and spray or surge function selector valve in accordance with the present invention.

An electric steam iron including a pump and spray or surge function selector valve in accordance with the present invention is shown in partial cross-section in FIG. 1 and is designated generally therein by the reference character 10. As shown, steam iron 10 includes a body portion 12, a handle 14 for manipulating the steam iron, a forward or nose portion 16, and an electrically heated soleplate 18. A water-containing reservoir 20 is formed within body portion 12 of steam iron 10 and contains a supply of water used for the generation of steam. As is well known in the art, steam iron 10 includes a fill port 34 by which reservoir 20 is periodically filled by the user. Reservoir 20 may include a transparent or translucent window (not shown) by which the level of water in the reservoir can be gauged by the user.

Steam iron 10 is provided with a user-operable temperature control 22 to control the electric power provided to soleplate 18 and a steam flow control knob 24 which controls the amount of steam issued from steam apertures (not shown) in soleplate 18, as is conventional in the art. Temperature control 22 is connected to a thermostat (not shown) that periodically opens and closes an electric circuit to supply power to soleplate 18 and thus establish the ironing temperature of the soleplate.

Soleplate 18 includes an interior surface portion 28 that is closed by a coverplate 30 to define a steam chamber 32 in which water from reservoir 20 is flashed to steam. Steam chamber 32 is connected to passageways (not shown) that lead to the steam apertures formed in the soleplate to provide the steam to the fabric being ironed.

The flow of water from reservoir 20 is controlled through actuation of knob 24. Knob 24 is connected via rod 36 to a metering valve (not shown). When steam flow control knob 24 is rotated, rod 36 moves axially to regulate the operation of the metering valve to control the flow of water from reservoir 20 into steam chamber 32.

Iron 10 further includes a water spray nozzle 46 mounted at the forward or nose portion 16. Spray nozzle 46 enables the user of the iron to emit a spray of water droplets onto the object to be ironed which is positioned in the path of movement of the iron. This spray function is used when ironing certain fabrics.

Steam chamber 32 includes a surge of steam function which operates to produce relatively large quantities of steam upon user demand. When the surge function is desired, a jet of water is suddenly introduced into the steam chamber. The surge function increases the speed and effectiveness of the steam iron in removing wrinkles from certain fabrics by enabling the user of the iron to selectively generate relatively large quantities of steam at intermittent times in the ironing process. To selectively obtain either the surge or spray functions, electric iron 10 includes a user operable control knob 50. Knob 50 extends above the top surface of iron 10 and is mounted within handle 14 for movement in either a rotational direction or in an axial direction relative to the handle.

A valve housing 52 formed from a moldable plastic, is axially spaced from the lower surface 54 of control knob 50. A spring 56 is resiliently mounted between the lower surface of control knob 50 and spring retaining ribs 58 formed on valve housing 52. Spring 56 is a compression spring and resiliently urges control knob 50 upwardly relative to the valve housing.

Figure 2:
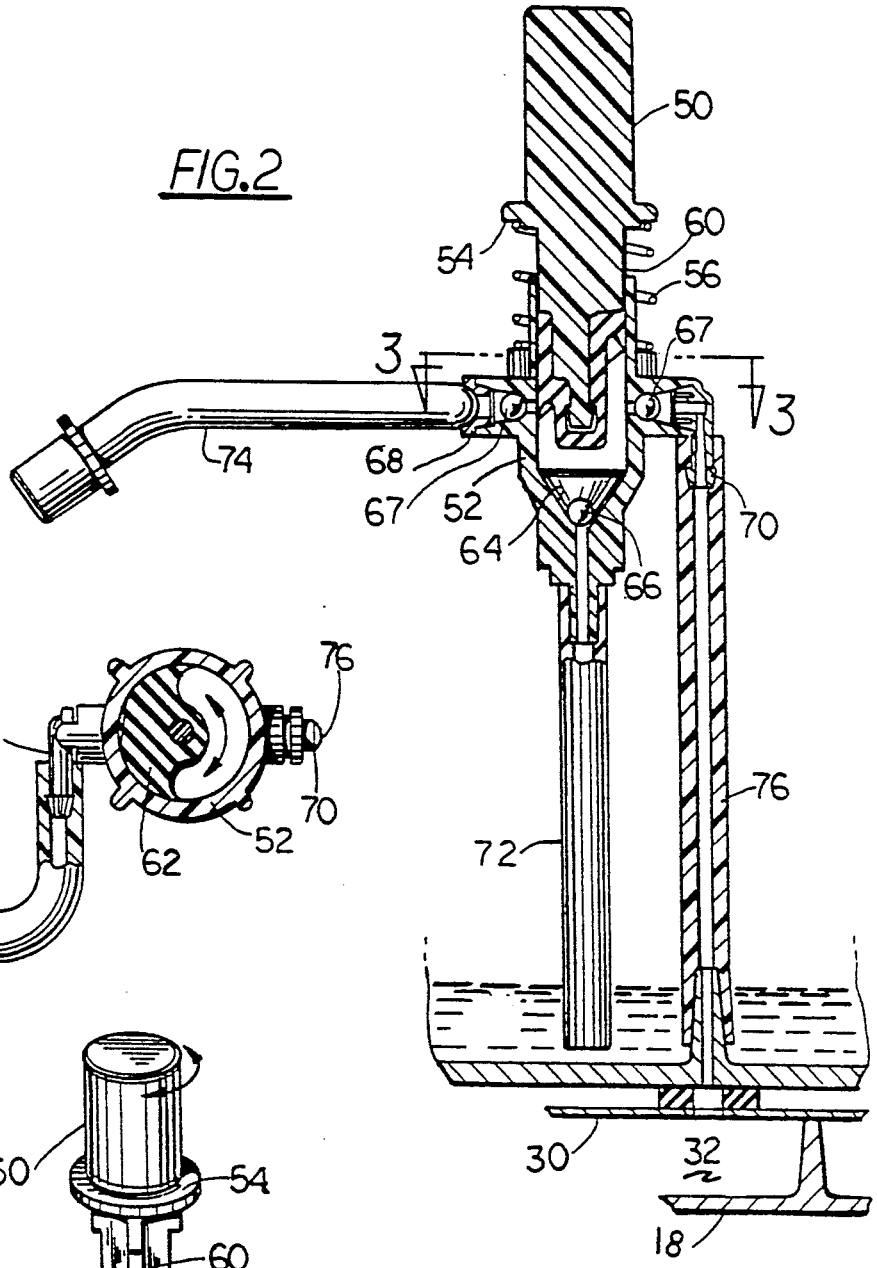
FIG. 2 is a detail of a portion of the electric iron illustrated in FIG. 1 particularly showing the manner in which the present invention is used within the iron.
Figure 3:
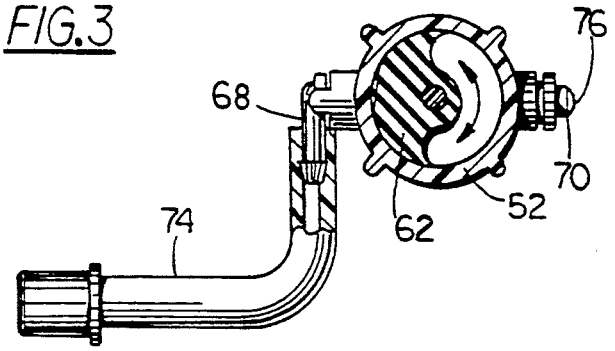
FIG. 3 is a sectional view taken along line-III of FIG. 2.
Figure 4:
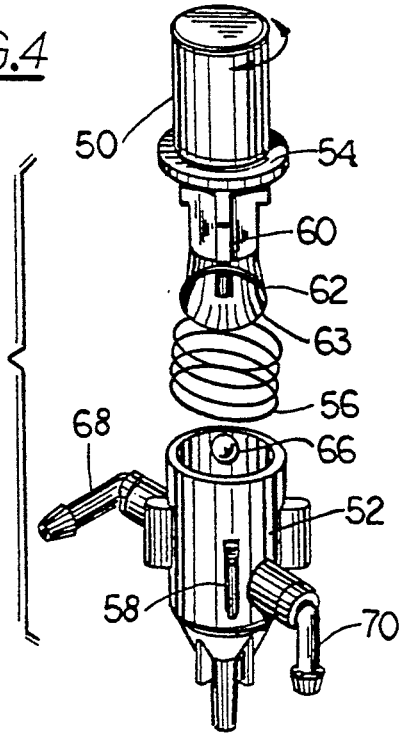
FIG. 4 is an exploded perspective view of the selector valve of the present invention.

Control knob 50 includes an axially extending stem portion 60 terminating in a valve member 62 which as illustrated in FIGS. 2–4 has a portion removed along a cut-line that is taken at an angle relative to the longitudinal axis of the stem.

With specific reference to FIGS. 2, 3 and 4, it will be observed that valve housing 52 has an inlet opening 64 formed at its lower end and in general alignment with the longitudinal axis of the valve stem. A ball check valve 66 is normally seated to control the flow of fluid through this opening. Valve housing 52 also includes a pair of nozzles 68, 70 formed in axial alignment and spaced circumferentially about the valve housing. Each nozzle 68, 70 has a ball check valve 67 to control the flow of fluid through the nozzles. Inlet opening 64 is connected to a first tube 72 which in turn communicates with water reservoir 20. The first one of the nozzles 68 is connected to a second tube 74 which, in turn, is connected to spray nozzle 46. The other of the nozzles 70 is connected to a third tube 76 which communicates with steam chamber 32.

As illustrated specifically in FIG. 3, as control knob 50 is rotated by the user, the cutaway portion of valve member 62 defined by the angled cut line 63 can be selectively communicated with one or the other of the nozzles 68, 70. The cutaway portion of valve member 62 forms an angled sealing surface. When the cutaway portion 63 of the valve member is aligned with nozzle 68 communicating with spray nozzle 46, water can flow from reservoir 20 through tube 72 to unseat ball check valve 66 and flow through inlet opening 64. The water then is supplied via nozzle 68 and second tube 74 to spray nozzle 46. When the control knob is rotated to align the cutaway portion 63 of valve member 62 with the other of the nozzles 70, as illustrated in FIG. 3, water will flow from the water reservoir, through tube 72, inlet opening 64, nozzle 70 and third tube 76 to steam chamber 32.

To obtain water flow, the user pumps control knob 50 in a reciprocating manner to cause water to flow upwardly through tube 72 to unseat check valve 66. Thence, depending upon the specific needs of the user, the water will flow either through one or the other of the nozzles 68, 70 as selected by the user to obtain either the spray or surge functions.

The described pump and spray or surge function selector valve of the present invention provides an effective and cost efficient arrangement for readily achieving the desired spray or surge functions within an electric iron. If desired, the design of valve member 62 may be modified. Specifically, the valve member may include a pair of axially spaced seals, with the lower seal having a portion removed to define a fluid flow path thereabout. The valve member will be rotated to align the removed portion of the seal with the nozzle providing the desired surge or spray function.

While a preferred embodiment of the present invention has been described and illustrated, the invention should not be limited thereto but maybe otherwise embodied within the scope of the following claims:

I claim:

1. An electric iron comprising a soleplate, a housing connected to the soleplate, and a water tank associated with the housing and having a water inlet and at least one water outlet, and a combination pump and spray or surge function select valve including:

an axially extending stem extending through said housing and having a first user operated member mounted at a first end and a valve member mounted at a second end;

valve housing means spaced circumferentially about the valve member and having a first water inlet in communication with said water outlet from said water tank and a pair of horizontally axially aligned and circumferentially spaced water outlets in fluid flow communication with said inlet, said stem being rotatable so that the valve member selectively connects said water inlet with a selected one of said outlets while discontinuing communication between said inlet and said other of said outlets, and said stem being axially movable relative to the housing means to pump water from said water inlet to said selected one water outlet, a first of said pair of water outlets providing water and for spray function and a second of said pair of water outlets providing water for said surge function; and said valve member including an angled sealing surface, with the angle of the sealing surface being relative to the longitudinal axis of the stem so that the sealing surface closes a selected one of the circumferentially spaced water outlets while opening the other of the outlets when said valve member is in a first rotatable position and opens said selected one of the water outlets while closing the other of the outlets when in a second rotatable position.

2. An electric iron in accordance with claim 1 wherein said valve member comprises a resilient molded member.

3. An electric iron in accordance with claim 2 wherein the stem includes a first flange-like surface and said valve housing means includes a plurality of retaining ribs, and a compression spring mounted between the flange-like surface and retaining ribs for normally urging the stem axially away from said housing means.

4. A combination pump and spray or surge function selector valve for an electric iron comprising:

a valve stem having a user operated member on a first end and a valve member on a second end;

housing means spaced circumferentially about the valve member and including a first water inlet and a pair of horizontally axially aligned and circumferentially spaced water outlets in fluid flow communication with said inlet, said stem being rotatably movable relative to said housing means so that the valve member selectively connects said water inlet with a selected one of said pair of water outlets while discontinuing communication between said inlet and said other of said outlets, and movable in an axial direction along the longitudinal axis of said stem to pump water from said inlet to said selected one water outlet; and said valve member including an angled sealing surface, with the angle of the sealing surface being relative to the longitudinal axis of the valve member so that the sealing surface closes a selected one of the water outlets while opening the other of the outlets when in a first rotatable position and opens said selected one of the outlets while closing the other of the outlets when in a second rotatable position.

5. A combination pump and spray or surge function selector valve in accordance with claim 4 wherein said valve comprises a resilient molded member.

6. A combination pump and spray or surge function selector valve in accordance with claim 5 wherein the stem includes a first flange-like surface and the housing means include a plurality of ribs, and a compression spring mounted between the flange-like surface and the ribs for normally urging the stem axially away from said housing means.

* * * * *